US005361926A

United States Patent [19]

Messner

[11] Patent Number: 5,361,926

[45] Date of Patent: Nov. 8, 1994

[54] COVER FOR CENTRIFUGE HOUSING

[75] Inventor: Johann Messner, Pasenbach, Germany

[73] Assignee: Krauss Maffei Aktiengesellschaft, Munich, Germany

[21] Appl. No.: 135,470

[22] Filed: Oct. 12, 1993

[30] Foreign Application Priority Data

Nov. 2, 1992 [DE] Germany ..... 4237018

[51] Int. Cl.[5] ..... B65D 43/16; B04B 7/02

[52] U.S. Cl. ..... 220/331; 220/333; 494/38; 494/60

[58] Field of Search ..... 494/10, 12, 39, 56, 494/60, 61, 85, 38; 366/143, 184, 188, 192, 193, 347; 220/331, 332, 333; 210/360.1, 380.1

[56] References Cited

U.S. PATENT DOCUMENTS

| | | | |
|---|---|---|---|
| 2,085,503 | 6/1937 | Lothian | 220/331 |
| 2,421,709 | 6/1947 | Miller . | |
| 2,639,144 | 5/1953 | Long | 220/333 X |
| 2,899,131 | 8/1959 | Wohler | 494/10 |
| 2,923,430 | 2/1960 | Stengele | 220/331 X |
| 3,257,073 | 6/1966 | Steimel | 494/60 X |
| 3,310,329 | 3/1967 | Luker . | |
| 3,768,203 | 10/1973 | Bellucci | 220/331 X |

FOREIGN PATENT DOCUMENTS

| | | | |
|---|---|---|---|
| 246652 | 4/1966 | Austria . | |
| 986800 | 12/1950 | France . | |
| 1091043 | 4/1961 | Germany . | |
| 3343939 | 6/1985 | Germany . | |
| 1034960 | 8/1983 | U.S.S.R. | 220/331 |
| 1139491 | 2/1985 | U.S.S.R. | 366/192 |

*Primary Examiner*—David A. Scherbel
*Assistant Examiner*—Charles Cooley
*Attorney, Agent, or Firm*—Herbert Dubno; Andrew Wilford

[57] ABSTRACT

A centrifuge has an upper wall formed with an inspection port, a cover engageable over the port, and an annular seal on the cover compressible against the port in a closed position of the cover. A hinge and operating assembly has a hydraulic cylinder/piston unit having one end pivoted on the housing, at least one pivot lug on the cover defining a cover axis, at least one pivot lug on the housing defining a housing axis parallel to the cover axis, and a support link having one end pivoted on the housing pivot lug at the housing axis and an opposite end defining a support axis. An operating lever centrally pivoted on the opposite end of the support link at the support axis has an end portion extending from the support axis and connected to the opposite end of the hydraulic unit and an opposite end portion on pivoted to one end of an operating link having an opposite end pivoted on the cover lug at the cover axis. When the unit is pressurized in the closed position of the cover the operating lever and operating link are pivoted so as initially to displace the cover axis in the closed position of the cover upward toward the support axis until the operating lever, in an intermediate position, engages the abutment and then pivots the cover about the housing axis away from the port into an open position of the cover.

8 Claims, 3 Drawing Sheets

COVER FOR CENTRIFUGE HOUSING

FIELD OF THE INVENTION

The present invention relates to a vertical-axis centrifuge. More particularly this invention concerns a cover or top for such a centrifuge.

BACKGROUND OF THE INVENTION

A standard vertical-axis centrifuge has an upright housing with an upper wall that is normally formed with a port or manhole in turn provided with a removable cover or lid. A seal ring is compressed between the outer periphery of the cover and the upper edge of the port and a clamping arrangement is provided to hold the cover down tight on the edge of the port during use of the centrifuge with the seal compressed.

In a standard prior-art arrangement such as described in German patent 1,091,043 issued 13 Apr. 1961 to G. Panzner or Austrian patent 246,652 issued 15 Aug. 1965 to F. Zellinger et al the port is provided at one side of its upper edge with a pair of pivot lugs having holes aligned on a horizontal axis tangent to the housing and the cover is provided with a similar such pair of lugs each positioned adjacent one of the housing lugs. A common pivot shaft extends through the four lugs so that the cover can be pivoted upward away from the housing about the axis of the shaft.

The main disadvantage of this system is that the seal is stressed excessively at its region adjacent the pivot shaft. As the cover is opened and closed this part of the seal is simultaneously compressed and shifted horizontally, typically rolling it over somewhat. Such biaxial movement does not uniformly compress the seal and subjects it to friction and torsion, so that it quickly wears out adjacent the hinge region.

In order to eliminate this problem it has been suggested in German patent document 3,343,939 filed 5 Dec. 1983 by E. Aufderhaar et al to provide a system which lifts the cover straight up off the housing at least until the seal disconnects from the housing in a direction perpendicular to the plane of the seal. Such an arrangement does indeed ensure that the seal is subjected to nothing but compression. Nonetheless this system is fairly complex and requires quite a bit of room for the cover to move in.

OBJECTS OF THE INVENTION

It is therefore an object of the present invention to provide an improved cover for a vertical centrifuge.

Another object is the provision of such an improved cover for a vertical centrifuge which overcomes the above-given disadvantages, that is which subjects the seal to unidirectional compression during closing and that also allows the door to be pivoted out of the way in a minimal amount of space.

SUMMARY OF THE INVENTION

The instant invention is used in a centrifuge having an upper wall formed with an inspection port having an annular edge, a cover engageable over the edge and having an annular edge engageable with the port edge, and an annular seal on the cover edge and compressible against the port edge in a closed position of the cover. According to the invention a hinge and operating assembly has a hydraulic cylinder/piston unit having one end pivoted on the housing and an opposite end, at least one pivot lug on the cover defining a cover axis, at least one pivot lug on the housing defining a housing axis parallel to the cover axis, and a support link having one end pivoted on the housing pivot lug at the housing axis and an opposite end defining a support axis. An operating lever centrally pivoted on the opposite end of the support link at the support axis has an end portion extending from the support axis and connected to the opposite end of the hydraulic unit and an opposite end portion on which is pivoted one end of an operating link having an opposite end pivoted on the cover lug at the cover axis. A retaining link has one end pivoted on the cover lug at the cover axis and an opposite end pivoted on the housing lug at the housing axis. A formation couples the support axis loosely to the cover and an abutment can engage the operating lever. When the unit is pressurized in the closed position of the cover the operating lever and operating link are pivoted so as initially to displace the cover axis in the closed position of the cover upward toward the support axis until the operating lever, in an intermediate position, engages the abutment and then pivots the cover about the housing axis away from the port into an open position of the cover. On opposite pressurization or depressurization the cylinder unit also oppositely pivots the operating lever and operating link to initially pivot the cover about the housing axis down through the intermediate position toward the port until the seal engages the cover edge and thereafter displaces the cover axis downward away from the support axis to return the cover to the closed position.

This multiple link system ensures that on opening the first movement will be solely perpendicular to the plane of the seal, merely decompressing it, and once the seal is clear, the cover will pivot away conventionally. On closing the movement is exactly opposite. Thus the seal will not be scraped and twisted as the cover opens and closes, but will solely be compressed and decompressed elastically so that it can be counted on to have a very long service life.

In accordance with this invention, in the closed position a pivot axis between the operating lever and the operating link lies to one side of a plane defined by the support and cover axes and in the intermediate position the pivot axis lies to the other side of the plane. The operating lever and operating link thereby forms a bistable toggle that will securely hold the lid shut without continuous pressurization of the cylinder.

Furthermore according to the invention the cover is provided with a plurality of such cover lugs and the housing has respective such housing lugs. The assembly has a respective such operating link at each housing lug and a throughgoing operating shaft extending through all the hinge assemblies and rotationally coupled at each of them to the respective operating link. Instead of a two-arm lever, the secondary hinge assemblies have simple links with upper ends pivoted at the support axis and lower ends pivoted on the upper ends of the respective operating links.

The formations and abutment are adjustable as is the connection between the cylinder unit and the two-arm lever. Thus the various rest positions and the extent of compression of the seal in the closed position can be adjusted.

So that the cover is stable in the open position, the cover moves through at least 90°, preferably 92° to 95°, on displacement between the open and closed positions. Furthermore the support axis is above the cover axis in the closed position and in the closed position the cover and housing axes are horizontally adjacent each other.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
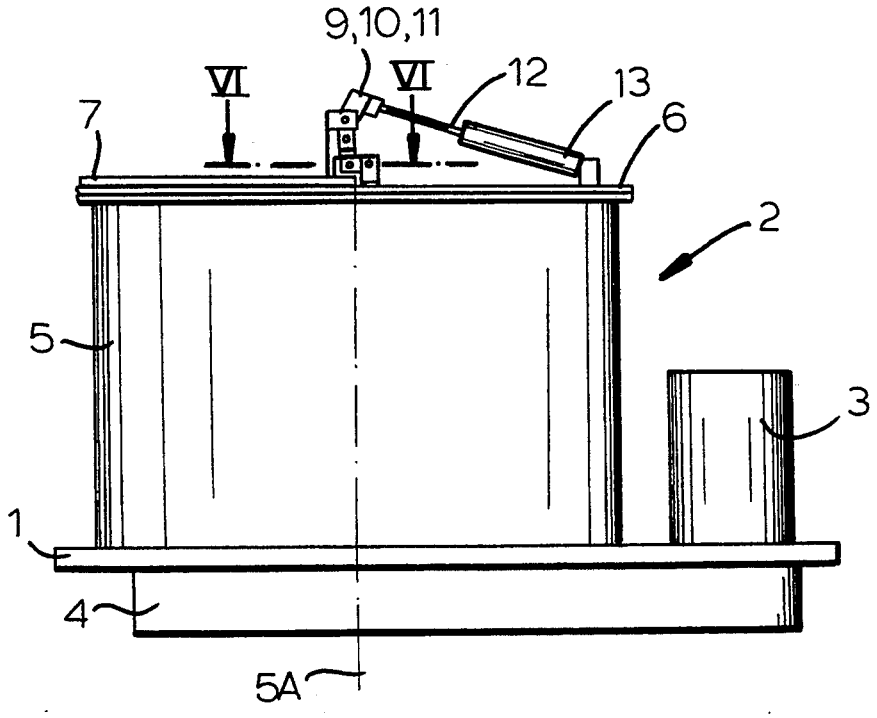
FIG. 1 is a side view of a centrifuge according to the invention.
Figure 2:
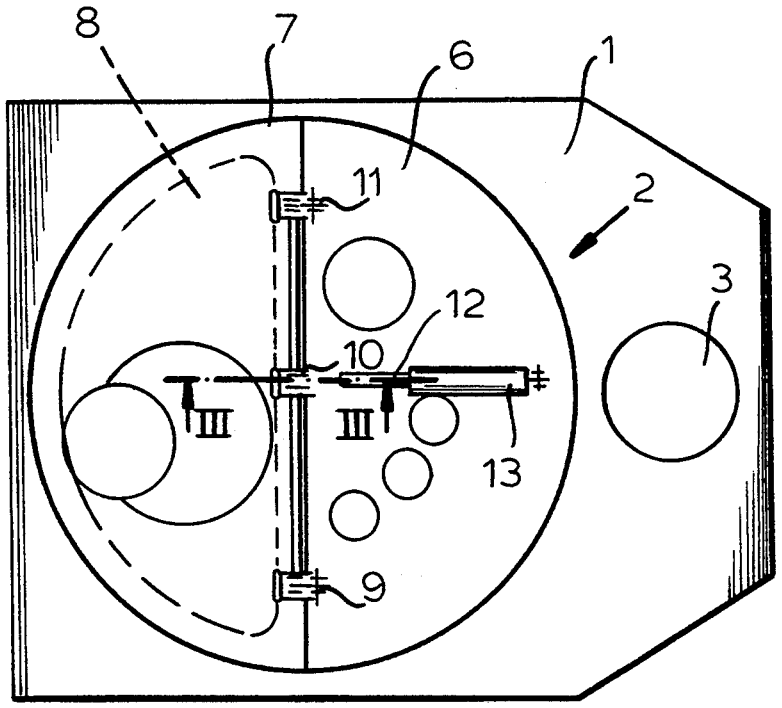
FIG. 2 is a top view of the centrifuge of FIG. 1.

As seen in FIG. 1 a vertical centrifuge has a base plate 1 supporting a motor 3 connected via a belt transmission in a housing 4 to an unillustrated rotor in an upright housing 5 centered on a vertical axis 5A and having an upper end covered by a top plate 6 formed with a semicircular inspection port 8. A cover plate 7 normally closes this port 8 and is connected by three identical hinge assemblies 9, 10, and 11 to the cover plate 7. A piston rod 12 of a double-acting hydraulic ram 13 pivots the cover 7 on the top plate 6 about a horizontal axis as described below. A seal ring 29 is seated in the outer edge of the lower face of the cover 7.

As better seen in FIGS. 3 through 6 the housing wall 6 is formed with three lug pairs 14 in which are seated respective cover pins 15 defining a common horizontal axis 15A on which three respective L-shaped support links 16 are pivoted. The upper ends of these support links 16 are secured by pivot pins 17 centered on a common axis 17A to elements 18 all of which are have lower ends in which are pivoted respective pivot pins 20 defining axes 20A. The element 18 of the central hinge 10 is formed as a two-arm lever whose upper portion is secured by a pivot pin 19 to a nut 33 threaded at 31 on the end of the piston rod 12 while the elements 18 of the hinges 9 and 11 are formed as simple links.

Respective operating links 21 have upper ends pivoted on the lower ends of the elements 18 at axis 20A and lower ends fixed on a rod 22 defining an axis 22A and pivoted in a lug 23 at each hinge assembly 9, 10, and 11. Keys 24 connect the rod 22 rotationally to each of the links 21 for joint movement. At each of the outer assemblies 9 and 11 there is a retaining link 25 having an outer end pivoted on the respective shaft 15 and an inner end pivoted on the shaft 22.

The cover 7 is formed at each assembly 9, 10, and 11 with an abutment eye 27 loosely surrounding the upper rod 17 and forming a vertically adjustable front abutment 26 engageable with the lower end of the respective element 18 and a rear abutment 28 engageable with the shaft 17. This abutment 28 is constituted by a bolt which can be screwed front to back to allow for some adjustment of the rear end position of the shaft 17 and basically serves to set the extent of compression of the seal 29. In addition the top wall 6 is provided at each hinge assembly with an abutment 30 engageable with an adjustment screw 32 on the respective support link 15 to define therefor the end positions of this link 15.

It would also be possible to provide each hinge assembly 9, 10, and 11 with such a connecting link 25. In this case the keys 24 or the rotational connection of the throughgoing shaft 22 with the second link 21 is unnecessary.

Figure 3:
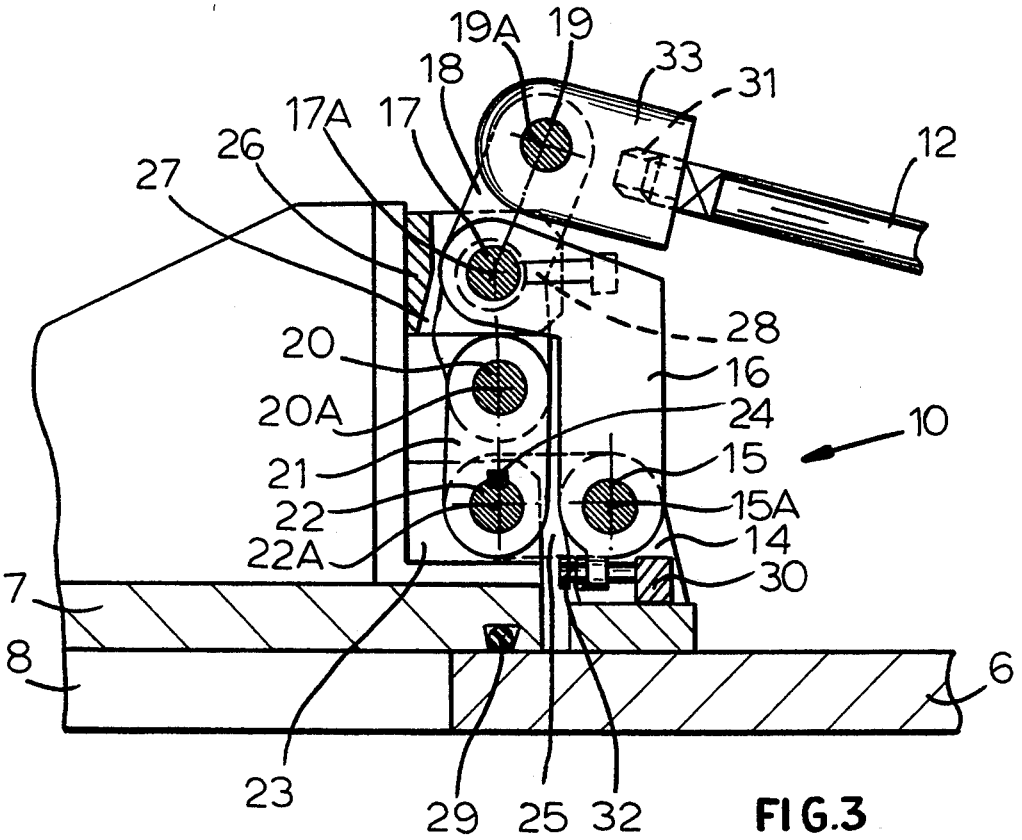
FIG. 3 is a large-scale section taken along line III—III of FIG. 2 in the closed position of the cover.

In the closed position shown in FIG. 3, the cover 7 is seated over the port 8 with the seal 29 downwardly compressed around the periphery of this port 7. The axis 20A lies slightly rearward of a plane defined by the parallel axes 17A and 22A and the shaft 17 bears backward against the abutment 28 so that the entire assembly is a stable toggle, even without pressurization of the cylinder unit 13.

Figure 4:
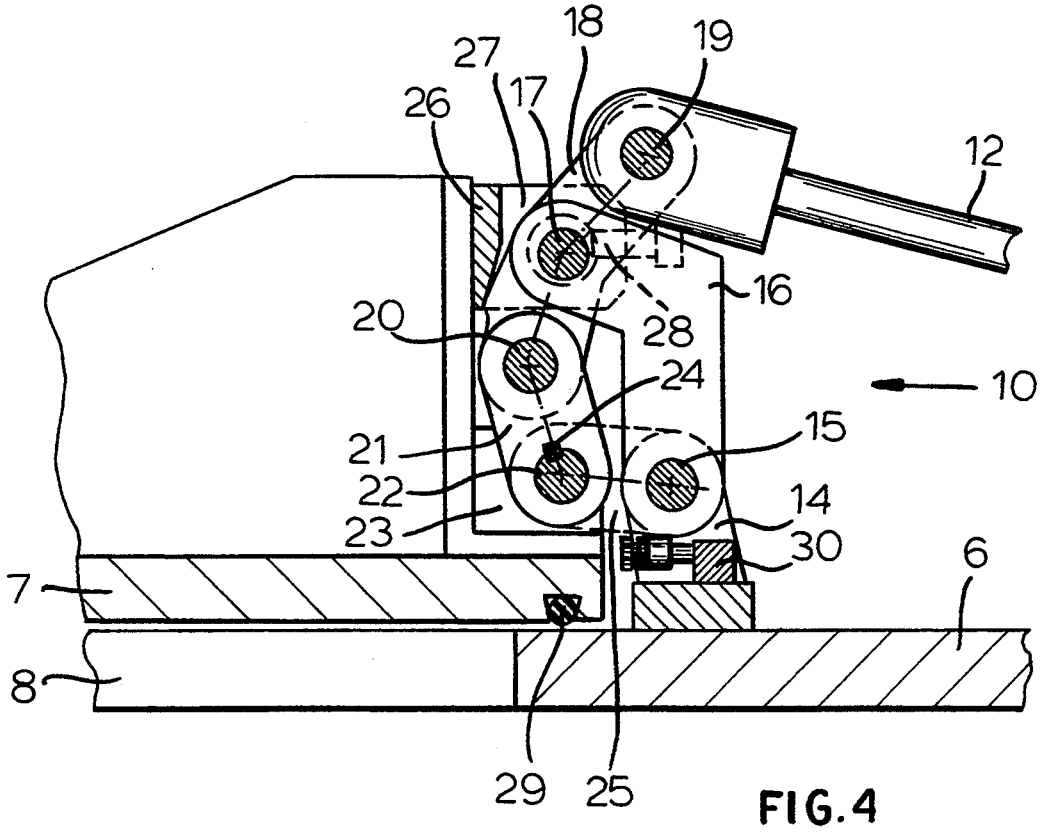
FIG. 4 is a view like FIG. 3 but after the first opening step has been completed.

To open the cover 7, the rod 12 is retracted to pull the axis 20A through the plane of the axes 17A and 22A until as seen in FIG. 4 the lower portion of the lever 18 comes to rest against the abutment 26 while the rod 17 presses backward against the abutment 28. This action moves the toggle through its metastable point with the axes 17A, 20A, and 22A coplanar and causes the axis 22A to move straight up toward the otherwise stationary axis 17A, pulling the seal 29 straight up and out of contact with the upper surface of the top wall 6. In this position further backward pivoting of the lever 18 relative to the cover 7 is made impossible by the abutment 26.

Figure 5:
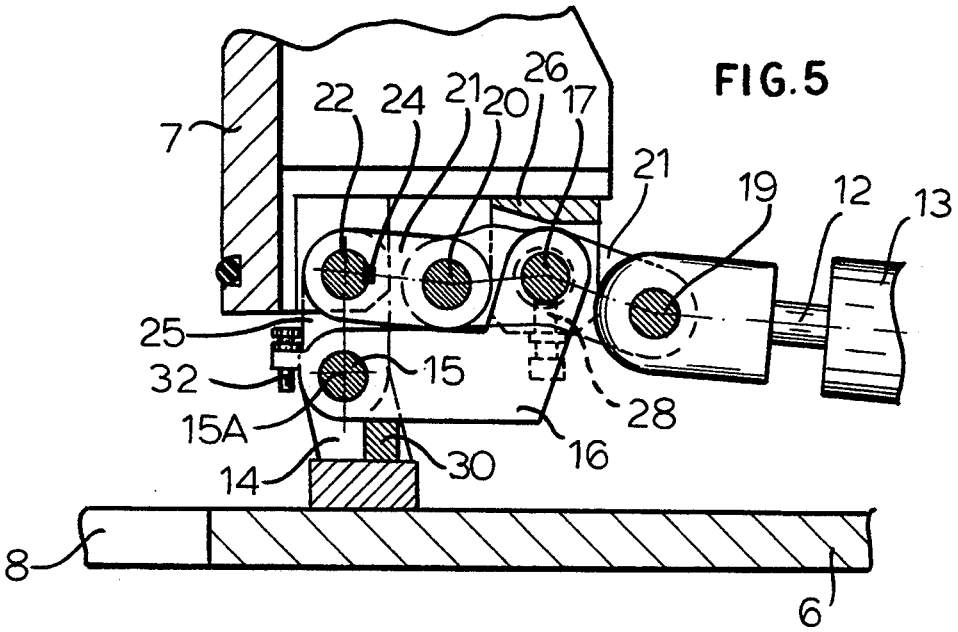
FIG. 5 is a view like FIG. 3 but with the cover completely open.
Figure 6:
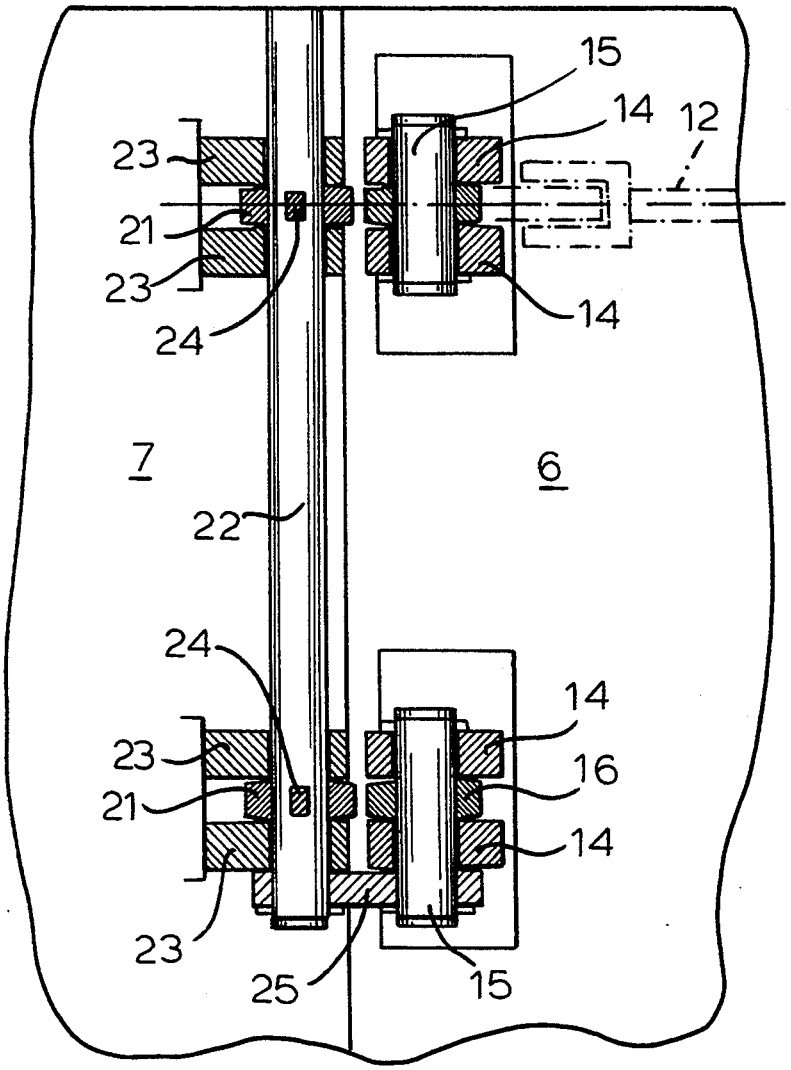
FIG. 6 is a section taken along line VI—VI of FIG. 1.

As the rod 12 continues to pull back as shown in FIG. 5, the entire cover 7 is pivoted up about the axis 15A until it has moved through slightly more than 90°, here 92°. The cover will remain in this position even if the cylinder 13 is relaxed. The end position is defined by contact of the links 16 with the tops of the abutment 30.

For closing, the piston rod 12 is extended to cause the above-described movements to take place in reverse. Thus whether opening or closing, the cover 7 will only move perpendicular to the plane of the top wall 6 for the time while the seal 29 is in contact with this top wall 6, preventing it from rubbing and/or getting twisted.

I claim:

1. In a centrifuge housing having an upper wall formed with an inspection port having an annular edge, a cover engageable over the edge and having an annular edge engageable with the port edge, and an annular seal on the cover edge and compressible against the port edge in a closed position of the cover, a hinge and operating assembly comprising:

a hydraulic cylinder/piston unit having one end pivoted on the housing and an opposite end;

at least one pivot lug on the cover defining a cover axis;

at lest one pivot lug on the housing defining a housing axis parallel to the cover axis;

a support link having one end pivoted on the housing pivot lug at the housing axis and an opposite end defining a support axis;

an operating lever centrally pivoted on the opposite end of the support link at the support axis and having an end portion extending from the support axis and connected to the opposite end of the hydraulic unit and an opposite end portion;

an operating link having one end pivoted on the opposite end portion of the operating lever and an opposite end pivoted on the cover pivot lug at the cover axis;

a retaining link having one end pivoted on the cover pivot lug at the cover axis and an opposite end pivoted on the housing pivot lug at the housing axis;

a formation coupling the support axis loosely to the cover;

an abutment engageable with the operating lever; and means for pressurizing the unit and thereby pivoting the operating lever and operating link so as initially to displace the cover axis in the closed position of the cover upward toward the support axis until the operating lever, in an intermediate position, engages the abutment and then to pivot the cover about the housing axis away from the port into an open position of the cover and also for oppositely pivoting the operating lever and operating link to initially pivot the cover about the housing axis down through the intermediate position toward the port until the seal engages the cover edge and thereafter to displace the cover axis downward away from the support axis to return the cover to the closed position.

2. The centrifuge hinge and operating assembly defined in claim 1 wherein in the closed position a pivot axis between the operating lever and the operating link lies to one side of a plane defined by the support and cover axes and in the intermediate position the pivot axis lies to the other side of the plane, the operating lever and operating link thereby forming a toggle.

3. The centrifuge hinge and operating assembly defined in claim 1 wherein the cover is provided with a plurality of such cover pivot lugs and the housing has at each cover lug a respective such housing pivot lug, the assembly comprising a respective such operating link at each housing pivot lug and a through-going operating shaft extending through all the cover pivot lugs and rotationally coupled to the respective operating link.

4. The centrifuge hinge and operating assembly defined in claim 1 wherein the formation and abutment are adjustable.

5. The centrifuge hinge and operating assembly defined in claim 1 wherein the cover moves through at least 90° on displacement between the open and closed positions.

6. The centrifuge hinge and operating assembly defined in claim 1 wherein the cover moves through 92° to 95° on displacement between the open and closed positions.

7. The centrifuge hinge and operating assembly defined in claim 1 wherein the support axis is above the cover axis in the closed position.

8. The centrifuge hinge and operating assembly defined in claim 7 wherein in the closed position the cover and housing axes are horizontally adjacent each other.

* * * * *